United States Patent [19]

Okamoto

[11] 4,028,978

[45] June 14, 1977

[54] SYNTHESIZER TYPE ELECTRONIC MUSICAL INSTRUMENT WITH VOLUME ENVELOPE DECAY TIME CONTROL

[75] Inventor: Eisaku Okamoto, Hamakita, Japan

[73] Assignee: Nippon Gakki Seizo Kabushiki Kaisha, Japan

[22] Filed: Dec. 19, 1975

[21] Appl. No.: 642,615

[30] Foreign Application Priority Data

Dec. 26, 1974 Japan ..... 50-156898[U]
Dec. 26, 1974 Japan ..... 50-156899[U]

[52] U.S. Cl. ..... 84/1.26; 84/1.13
[51] Int. Cl.² ..... G10H 1/02
[58] Field of Search ..... 84/1.01, 1.03, 1.23, 84/1.09–1.13, 1.19, 1.21, 1.24, 1.26, 1.27

[56] References Cited

UNITED STATES PATENTS 3,848,092 11/1974 Shamma ..... 84/1.27
3,886,836 6/1975 Hitoshi ..... 84/1.13
3,902,392 9/1975 Nagahama ..... 84/1.01
3,949,639 4/1976 Adachi ..... 84/1.27

*Primary Examiner*—Robert K. Schaefer
*Assistant Examiner*—Vit W. Miska
*Attorney, Agent, or Firm*—Flynn & Frishauf

[57] ABSTRACT

A synthesizer type electronic musical instrument in which a volume envelope imparted to a tone signal decays with a decay time after release of a key. In such an electronic musical instrument, the decay time of the volume envelope is caused to vary according to the note of the key being actuated. As a decay time controlling signal, a pitch determining voltage signal is applied to a control voltage generator for a voltage-controlled amplifier, or is adapted to control a control voltage from the control voltage generator so that the control voltage may be of a waveform having a decay time which depends on the magnitude of the pitch determining voltage signal.

5 Claims, 5 Drawing Figures

SYNTHESIZER TYPE ELECTRONIC MUSICAL INSTRUMENT WITH VOLUME ENVELOPE DECAY TIME CONTROL

BACKGROUND OF THE INVENTION

This invention relates to a synthesizer type electronic musical instrument.

In a conventional synthesizer type electronic musical instrument wherein such a volume envelope as decays in a decay time after release of a key is imparted to a tone signal from a voltage-controlled oscillator, the decay time is the same for all the notes since the control voltage having a preset shape is applied from a control voltage generator to a voltagecontrolled amplifier or envelope-providing variable gain amplifier.

In a musical instrument such as a piano, however, the decay time of a sound after string-striking differs from that of another sound according to the tone pitch. That is, it is relatively short if the tone pitch is high and relatively long if the tone pitch is low.

Thus, it is possible even with a synthesizer type electronic musical instrument to provide a better sound effect if the decay times after releases of keys are different in accordance with the tone pitch or the note of the actuated key.

SUMMARY OF THE INVENTION

Accordingly, the object of this invention is to provide a synthesizer type electronic musical instrument capable of varying the decay time of a volume envelope after release of a key according to the note of the actuated key.

According to this invention, the decay time, after release of a key, of a control voltage to be supplied to an envelope providing amplifier is controlled by a pitch determining voltage signal which is produced in response to the actuation of the key on the keyboard and which has a magnitude corresponding to the note of the actuated key. The decay time may be controlled in such a manner that it becomes shorter as the tone pitch is higher.

In an embodiment of this invention, the pitch determining voltage signal is applied together with a decay time controlling voltage signal from a parameter controlling voltage signal generator to the decay time controlling voltage signal receiving terminal of a control voltage generator which is supplied also with various parameter controlling voltage signals from the parameter controlling voltage signal generator, the parameter controlling voltage signals serving to shape the waveform of the control voltage. As a result, the decay time of the control voltage after release of the key is made dependent on the magnitude of the pitch determining voltage signal.

In another embodiment of this invention, there is provided between a control voltage generator and an envelope providing amplifier such means as controls the level of the control voltage in accordance with the magnitude of the pitch determining voltage signal.

DESCRIPTION OF THE PREFERRED EMBODIMENTS

Figure 1:
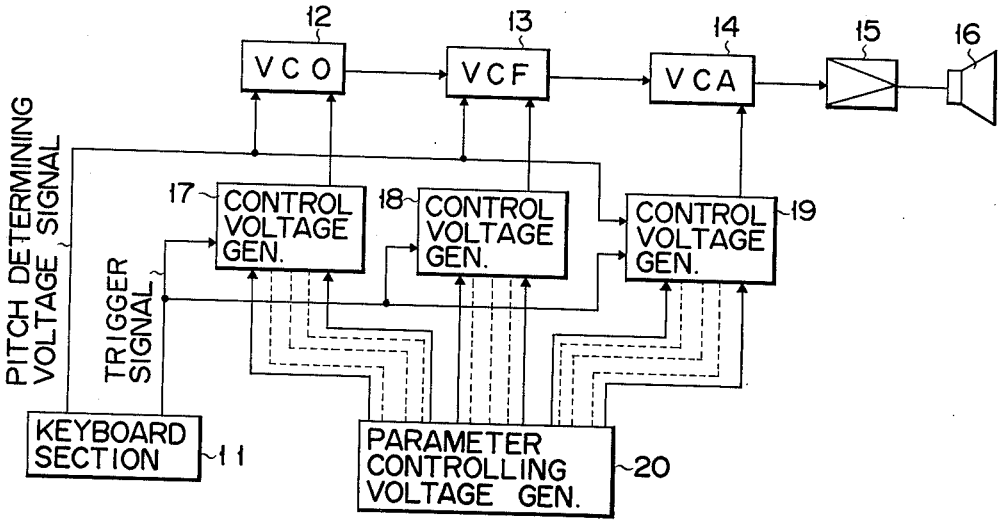
FIG. 1 is a block diagram of the electronic musical instrument according to this invention.

In FIG. 1, reference numeral 11 denotes a keyboard section for producing a pitch determining voltage signal with a magnitude corresponding to the note of a key actuated on a keyboard and a trigger signal representing the actuation of the key. The trigger signal is initiated almost simultaneously with the key actuation and terminated almost simultaneously with the key release.

The pitch determining voltage signal is applied to a voltage-controlled oscillator (hereinafter called "VCO") 12 through a storage capacitor (not shown), thereby producing a tone signal having a frequency (pitch) of the note of the key being actuated on the keyboard. The tone signal is then applied to a voltage-controlled filter (hereinafter called "VCF") 13 which provides the tone signal with a desired tone color. Also to VCF 13 the pitch determining voltage signal is supplied so that VCF 13 has a cutoff frequency suitable for the note of the tone signal being treated.

The filtered tone signal from VCF 13 is supplied to a voltage-controlled amplifier (hereinafter called "VCA") 14 for providing a desired volume (amplitude) envelope to the tone signal, and in turn to a power amplifier 15 and to a loudspeaker 16.

The trigger signal from the keyboard section 11 triggers control voltage generators 17, 18 and 19, which produce control voltages to be supplied to VCO 12, VCF 13 and VCA 14, respectively. These control voltages have such a waveform as rises from an initial level to an attack level in an attack time, decays from the attack level to a sustain level in a first decay time, and, after the key release, decays from the sustain level to the initial level in a second decay time. According to the waveform envelope of the control voltages, VCO 12 changes its oscillation frequency, VCF 13 its cutoff frequency, and VCA 14 its gain. VCA 14 remains in cutoff condition so long as it is not supplied with the control voltage from the control voltage generator 18, while VCO 12 keeps generating the tone signal of the same frequency even after the key release owing to a charge on the storage capacitor.

The control voltage generators 17 to 19 may be supplied from a generator 20 with parameter controlling voltage signals which control various parameters determining the shape of each control voltage. According to this invention, the pitch determining voltage signal is supplied also to the control voltage generator 19 from the keyboard section 11 so as to control mainly the decay time, after the key release, of the control voltage to be supplied to VCA 14.

Figure 2:
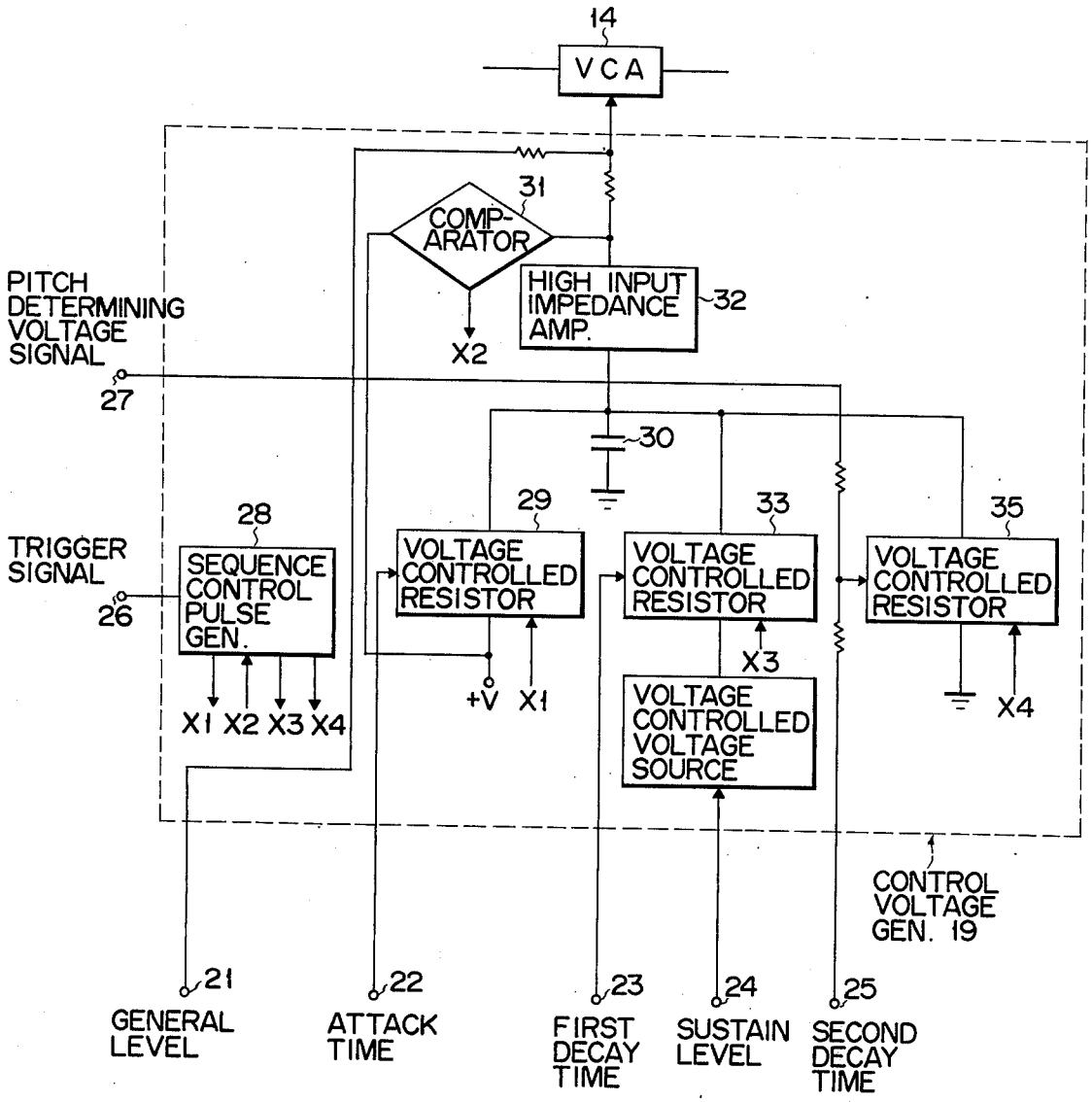
FIG. 2 is an exemplary circuit diagram of the control voltage generator for providing a volume envelope to a tone signal according to a first embodiment of this invention.

FIG. 2 shows one example of the known control voltage generator 19. The control voltage generator 19 has input terminals 21 to 25 respectively for receiving parameter control voltage signals determining such parameters of the control voltage as a general level, an attack time, a first decay time, a sustain level and a second decay time which define the waveform of the control voltage. It has two other input terminals 26 and 27 for receiving the trigger signal and the pitch determining voltage signal, respectively.

The trigger signal is supplied to a sequence control pulse generator 28. The pulse generator 28 produces a pulse X1 in response to the initiation of the trigger signal on the key depression and a pulse X4 in response to the termination of the trigger signal or the key release.

The pulse X1 enables a voltage-controlled resistor 29. As a result, a storage capacitor 30 charges from ground potential up to a peak level +V. The resistance value of the voltage-controlled resistor 29 is determined by the attack time controlling voltage signal from the terminal 22. For this reason, the charging time during which the storage capacitor 30 charges from the ground potential to the peak level, that is, the attack time depends on the magnitude of the attack time controlling voltage signal. When the voltage across the capacitor 30 reaches the peak level +V, a pulse X2 is produced by a voltage level comparator 31 having one input terminal coupled to the capacitor 30 through a high input impedance buffer amplifier 32 and another input terminal coupled to a +V power source. Upon generation of the pulse X2, the generation of the pulse X1 is stopped, thus disabling the voltage-controlled resistor 29. In response to the pulse X2, the sequence control pulse generator 28 produces a pulse X3, which enables a voltage-controlled resistor 33. Then, through the voltage-controlled resistor 33 the capacitor 30 discharges down to the output voltage level of a voltage-controlled voltage source 34 which corresponds to the sustain level of the waveform. The time required for this discharge, i.e. the first decay time is determined by the first decay time controlling voltage signal from the terminal 23.

The output voltage of the voltage-controlled voltage source 34 is determined by the magnitude of the sustain level controlling voltage signal from the terminal 24. The sustain level lasts until the key release, that is, until the generation of the pulse X4. When the pulse X4 is produced, it enables a voltage-controlled resistor 35, whereby the storage capacitor 30 discharges through the resistor 35 down to the ground potential. The time required for this discharge, i.e. the second decay time depends on the magnitude of the second decay time controlling voltage signal which determines the resistance value of the voltage-controlled resistor 35.

The voltage waveform thus formed at the storage capacitor 30 is supplied as a control voltage jointly with the voltage decisive of the general level from the terminal 21 to VCA 14 so that the tone signal may have an envelope according to the shape of the control voltage.

Figure 4A:
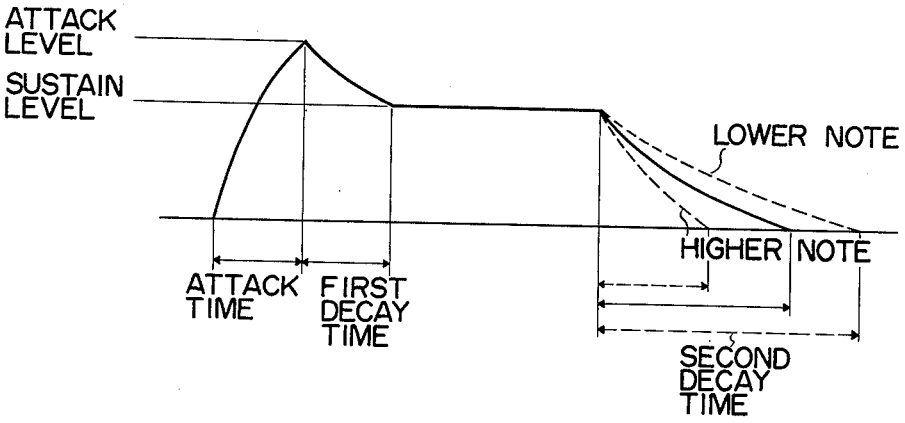
FIG. 4A shows a waveform of a volume envelope providing control voltage according to the first embodiment of this invention.

In this embodiment, the pitch determining voltage signal is supplied also to the voltage-controlled resistor 35. The resistance value of the resistor 35, i.e. the second decay time, therefore depends on the magnitude of the pitch determining voltage signal, too. Consequently, if the magnitude of the pitch determining voltage signal increases as the tone pitch becomes higher and if the resistor 35 exhibits a lower resistance value to a higher input voltage, the second delay time becomes shorter for a higher note than for a lower note as shown in FIG. 4A.

Figure 3:
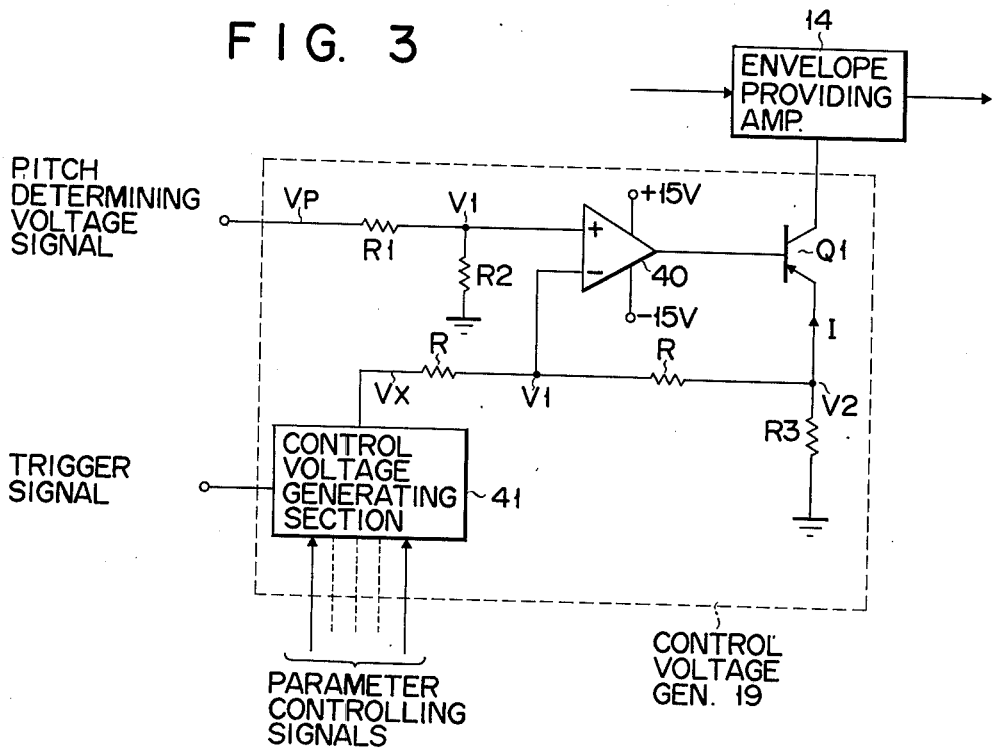
FIG. 3 is an exemplary circuit diagram of the control voltage generator for providing a volume envelope to a tone signal according to a second embodiment of this invention.

FIG. 3 shows another example of the control voltage generator 19. The control terminal of the variable gain amplifier 14, which may be, for example, RCA CA 3080, is connected to the collector of a transistor Q1. The emitter of the transistor Q1 is connected to ground through a resistor R3. The pitch determining voltage signal is coupled through a voltage divider comprised of resistors R1 and R2 to the non-inverting input of a differential amplifier 40, which may be such an operational amplifier as Fairchild μPC 741HC. To the junction between the emitter of the transistor Q1 and the resistor R3 is connected through two serially connected equal resistors R the output terminal of a control voltage generating section 41 of such construction as shown in FIG. 2 except the line from the terminal 27. Further, the junction of the two serially connected resistors R is coupled to the inverting input of the operational amplifier 40. The output terminal of the operational amplifier 40 is coupled to the base of the transistor Q1.

Suppose the resistance value of the resistors R is so large that the current flowing through them is negligible. Then, the following equations are established.

$$V1 = \frac{R2}{R1 + R2} VP$$

$$I = -\frac{V2}{R3}$$

$$\frac{Vx + V2}{2} = V1$$

Thus:

$$I = \frac{Vx - 2\frac{R2}{R1 + R2} VP}{R3},$$

where $I$ denotes the current flowing through the transistor $Q1$, $V1$ the voltage at the inputs of the operational amplifier $R$, $V2$ the voltage at the emitter of transistor $Q1$, $VX$ the control voltage, and $VP$ the pitch determining voltage signal.

Figure 4B:
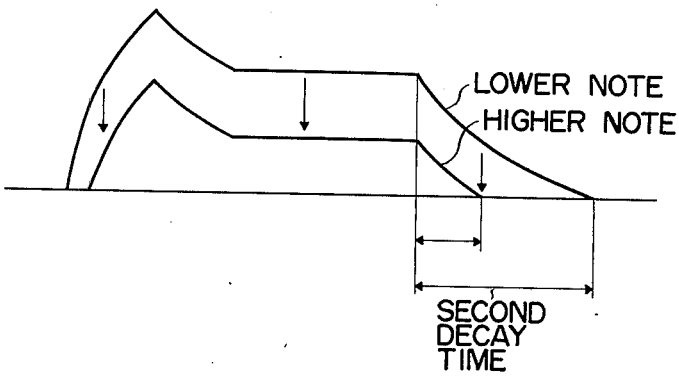
FIG. 4B shows a waveform of a volume envelope providing control voltage according to the second embodiment of this invention.

Evidently, the transistor current $I$ decreases as the magnitude of the pitch determining voltage signal becomes greater. In response to the variation of the current $I$, the gain of the variable gain amplifier 14 decreases as the magnitude of the pitch determining voltage signal becomes greater. If the magnitude of the pitch determining voltage signal is so made as to increase as the tone pitch becomes higher, the reference level of the control waveform given to the variable gain amplifier 14 becomes apparently higher as the tone pitch becomes higher. In consequence, as shown in FIG. 4B, the overall amplitude of the control waveform is decreased as the tone pitch becomes higher, thus consequently shortening the second decay time.

What is claimed is:

1. An electronic musical instrument comprising:

a keyboard section including a keyboard having keys and means responsive to actuation of a key on the keyboard to produce a pitch determining voltage signal whose voltage value is a function of the note of the key being actuated and a trigger signal indicating a depression and a release of a key;

tone signal generating means coupled to receive the pitch determining voltage signal from said keyboard section for producing a tone signal having a frequency corresponding to the key being actuated, said tone signal generating means continuing to produce the tone signal of said frequency after release of the key;

envelope providing means coupled to receive the tone signal from said tone signal generating means and the pitch determining voltage signal and the trigger signal from said keyboard section for providing the tone signal with an envelope which decays with a decay time after said trigger signal indicates the release of the key, said decay time being a function of the pitch determining voltage signal.

2. An electronic musical instrument comprising:

a keyboard section including a keyboard having keys and means responsive to actuation of a key on the keyboard for producing a first signal corresponding to the note of the key being actuated and a second signal representing the actuation of the key;

tone signal generating means coupled to receive the first signal from said keyboard section for producing a tone signal having a frequency corresponding to the key being actuated, said tone signal generating means continuing to produce the tone of said frequency signal after release of the key;

control voltage generating means coupled to receive the second signal from said keyboard section for producing a control voltage having a waveform which decays with a decay time after termination of the second signal and having voltage-controlled parameters which define the waveform of said control voltage and which include the decay time, said control voltage generating means having terminals for receiving parameter controlling voltage signals, including a terminal for receiving a decay time controlling voltage signal;

means for generating and coupling parameter control voltage signals including the decay time controlling voltage signal to the corresponding terminals of said control voltage generating means;

a variable gain amplifier means coupled to receive the tone signal from said tone signal generating means and responsive to the control voltage for providing the tone signal with the envelope of the shape of the control voltage; and means for coupling the first signal to the decay time controlling voltage signal receiving terminal of said control voltage generating means, said decay time of the control waveform being also a function of the magnitude of the first signal.

3. The electronic musical instrument according to claim 2 wherein the decay time of the control voltage is shorter for a high note tone signal than for a lower note tone signal.

4. An electronic musical instrument comprising:

a keyboard section comprising a keyboard having keys and means responsive to actuation of a key on the keyboard for producing a first signal corresponding to the note of the key being actuated and a second signal representing the actuation of the key;

tone signal generating means coupled to receive the first signal for producing a tone signal having a frequency corresponding to the key being actuated, said tone signal generating means continuing to produce the tone signal of said frequency after release of the key;

control voltage generating means coupled to receive the second signal from said keyboard section for producing control voltage having a waveform which decays with a decay time after termination of the second signal;

a variable gain amplifier means coupled to receive the tone signal from said tone signal generating means and responsive to the control voltage for providing the tone signal with the envelope of the shape of the control voltage; and means coupled between said variable gain amplifier means and to said control voltage generating means and responsive to the magnitude of the first signal for controlling the magnitude of the control voltage to be coupled to said variable gain amplifier means, thereby consequently changing the decay time of the envelope to be given to the tone signal.

5. The electronic musical instrument according to claim 4 wherein said last-mentioned means makes the decay time of the control voltage shorter for a higher note tone signal than for a lower note tone signal.

* * * * *